US009611706B2

(12) United States Patent
Pinckard

(10) Patent No.: US 9,611,706 B2
(45) Date of Patent: Apr. 4, 2017

(54) WELL INTERVENTION DEVICE AND OFFSHORE FLOATING INSTALLATION

(71) Applicant: Fugro N.V., Leidschendam (NL)

(72) Inventor: Mitchell Pinckard, Tool, TX (US)

(73) Assignee: Fugro N.V., Leidschendam (NL)

( * ) Notice: Subject to any disclaimer, the term of this patent is extended or adjusted under 35 U.S.C. 154(b) by 0 days.

(21) Appl. No.: 14/939,131

(22) Filed: Nov. 12, 2015

(65) Prior Publication Data

US 2017/0044847 A1 Feb. 16, 2017

Related U.S. Application Data

(60) Provisional application No. 62/203,404, filed on Aug. 11, 2015.

(51) Int. Cl.

| | |
|---|---|
| ***E21B 15/02*** | (2006.01) |
| ***E21B 19/09*** | (2006.01) |
| ***E21B 19/22*** | (2006.01) |
| ***E21B 19/00*** | (2006.01) |
| ***E21B 17/20*** | (2006.01) |
| ***E21B 19/08*** | (2006.01) |
| ***E21B 3/02*** | (2006.01) |

(52) U.S. Cl.

CPC ..... *E21B 19/006* (2013.01); *E21B 3/02* (2013.01); *E21B 15/02* (2013.01); *E21B 17/20* (2013.01); *E21B 19/08* (2013.01); *E21B 19/22* (2013.01)

(58) Field of Classification Search

CPC . E21B 3/02; E21B 15/02; E21B 17/20; E21B 19/006; E21B 19/08; E21B 19/09; E21B 19/22

See application file for complete search history.

(56) References Cited

U.S. PATENT DOCUMENTS

| | | | | |
|---|---|---|---|---|
| 6,343,893 | B1 * | 2/2002 | Gleditsch | E21B 19/006 114/264 |
| 6,470,969 | B1 * | 10/2002 | Sørhaug | E21B 19/006 166/352 |
| 6,901,998 | B1 * | 6/2005 | Roodenburg | E21B 19/002 166/85.1 |
| 6,932,553 | B1 * | 8/2005 | Roodenburg | E21B 15/003 166/343 |
| 7,163,061 | B2 * | 1/2007 | Moncus | E21B 19/22 114/264 |

(Continued)

FOREIGN PATENT DOCUMENTS

| | | | | |
|---|---|---|---|---|
| GB | 2343466 A | * | 5/2000 | E21B 19/09 |
| GB | 2418684 | * | 4/2006 | |

*Primary Examiner* — Matthew R Buck

(74) *Attorney, Agent, or Firm* — Polsinelli PC

(57) ABSTRACT

Mobile Offshore Drilling Units (MODUs) are more susceptible to meteorological conditions such as winds, currents and, most importantly, waves. These meteorological conditions generate a movement of the installation that will inevitably be transferred to some extent to the drilling pipe. A mobile offshore drilling unit can include a rooster box configured to move the rooster box along the height of a derrick to which it is attached. An injector configured to attach to an intervention frame of the rooster box, wherein the injector is configured to be releasably coupled to a conduit The injector configured to be positioned on-axis with the conduit in a first configuration and off-axis with the conduit in a second configuration.

19 Claims, 5 Drawing Sheets

(56) References Cited

U.S. PATENT DOCUMENTS

| | | | | |
|---|---|---|---|---|
| 7,191,839 | B2 * | 3/2007 | Carriere | E21B 19/22 166/379 |
| 7,306,404 | B2 * | 12/2007 | Torgersen | E21B 19/02 166/355 |
| 7,431,092 | B2 * | 10/2008 | Haheim | E21B 19/22 166/343 |
| 7,789,155 | B2 * | 9/2010 | Moncus | E21B 19/22 166/313 |
| 8,191,636 | B2 * | 6/2012 | Coles | E21B 19/006 166/250.01 |
| 8,511,385 | B2 * | 8/2013 | Sorenson et al. | E21B 19/22 166/339 |
| 9,297,220 | B2 * | 3/2016 | Beck | E21B 19/004 |
| 9,309,730 | B2 * | 4/2016 | Korach | E21B 15/00 |
| 2008/0099208 | A1 * | 5/2008 | Moncus | E21B 19/09 166/338 |
| 2009/0025937 | A1 * | 1/2009 | Robinson | E21B 15/003 166/351 |
| 2011/0067887 | A1 * | 3/2011 | Moncus | E21B 19/22 166/384 |
| 2012/0318530 | A1 * | 12/2012 | Wollum | E21B 19/22 166/379 |
| 2014/0308105 | A1 * | 10/2014 | Soertveit | E21B 19/006 414/592 |
| 2015/0090464 | A1 * | 4/2015 | Johnston | E21B 19/002 166/385 |

* cited by examiner

WELL INTERVENTION DEVICE AND OFFSHORE FLOATING INSTALLATION

FIELD OF TECHNOLOGY

The present disclosure relates to subsea well intervention, in particular, a device for multi-purpose well intervention disposed on a vessel, wherein the well intervention device has the advantage of safer and quicker transfer between several modes of operation, such modes of operations can be categorized as on-axis activities and off-axis activities.

BACKGROUND

There are different classes of offshore installations. For example, mobile offshore drilling units, floating platforms, fixed platforms, and tension legs. Each of these installations has their own applications and drawbacks.

Mobile offshore drilling units (MODU) are more susceptible, than other types of offshore structures to meteorological conditions such as winds, currents and, most importantly, waves. These meteorological conditions generate movement of the MODU that will inevitably be transferred to some extent to the drilling pipe, which is fixedly connected to the wellhead located in a fix spot on the seabed. When the drilling pipe is connected to the wellhead (e.g., for well intervention or drilling), the MODU utilizes a passive heave compensation system. When there is no drilling pipe connected (e.g., open sea drilling), the MODU utilizes an active heave compensation system.

Several motion intervention devices are known, for example, the use of motion intervention frames is a widely known technique in coiled tubing drilling activities. Therein the coiled tubing injector is attached to a frame that, generally, through the use of winches, is hung to a fixed structure; the winches are pneumatically or hydraulically controlled to follow the injector and thereby compensate for the relative movement between the injector and the pipeline to which the injector acts on. U.S. Patent Publication US20140308105A1 teaches an example of such motion intervention devices.

Prior art devices acknowledge the presence of meteorological conditions that modify the position of pipelines that are connected to the seafloor with respect to the vessel (and, therefore, of every intervention device located on such vessel) and have developed different kinds of frames to minimize the effects of the dynamic loads of the intervention devices and their movement with respect to the pipeline. Such compensating action is always performed on the intervention devices themselves (e.g., by hanging the intervention device to a constant-tension winch or by modifying the position of the intervention devices in view of the load of a wellhead so that it does not exceed a determined threshold value).

One of the major problems with the prior art systems is that during coiled tubing drilling a coiled tubing lifting frame (CTLF) is normally used. The CTLF is a massive structure that needs to be handled in an unmounted way and that is mounted below the derrick (i.e., it is normally too large to be mounted outside the derrick). The CTLF is subsequently hung from the top of the derrick and the injector is attached on the CTLF. When operations are to be performed on a pipeline (e.g. wireline operations for inspecting or maintaining the pipeline) the injector has to be lowered back to the vessel and the CTLF removed for safety reasons (i.e., it is unsafe to keep workers under a hanging structure). The operation process normally takes a long time (e.g., 4-6 hours) and can slow down and make drilling operations more expensive.

Another problem of prior art systems is taking measurements during well intervention operations. Specifically, switching between coiled tubing and wireline operations is a time consuming process. In traditional systems using a CTLF (as illustrated above) it can take 4-6 hours to remove the injector and configure wireline. The time spent changing configurations can add to the cost of the intervention operation.

Another problem of prior art systems is that operations to be performed on the drill riser (i.e., while the injector is attached to the pipeline) are typically performed by a man-rider or harnessed worker (e.g., by crane). Thus, it can be difficult to perform complex operations or to perform work between several people. Furthermore, if work is to be performed on the injector is has to be lowered to the deck of the vessel. In both of these cases, the use of prior art techniques result in a timely and risky operation.

Another problem encountered with the prior art systems, is the complexity of changing from a coiled tubing drilling to a joint-pipe drilling configuration. (e.g, to change from an injector to a top-drive). In prior art systems, the intervention frame must be reconfigured to a new weight and the injector has to be disengaged from the conduit and removed to a platform (i.e., on the vessel). The movement of such a heavy device is unsecured and the vessel is subject to movements that can damage the device. Furthermore, the change between modes requires a considerable amount of time.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

The present disclosure solves the above-mentioned problems by modifying the approach of movement intervention for different modes of operations as described below. The MODU has two modes of operation: well intervention mode and drilling mode. In well intervention mode a conduit can be attached to a rooster box. The conduit can be maintained at a determined upright tension that can be monitored by the rooster box. In drilling mode, the rooster box can push down the conduit and the downward force from the rooster box (i.e., compressive force) can to be monitored (e.g., by the rooster box).

Also, in some drilling mode operations, the rooster box can allow a controlled fraction of the drilling conduit weight to be imparted to the drill bit (weight on bit) whilst the majority of the conduit remains in tension due to self-weight, in this case, no compressive forces are performed as the downward force is exerted by the weight of the conduit.

In some embodiments, maintaining a force (e.g., an upward force, downward force, etc.) on a conduit (e.g., pipeline, riser, drill pipe, etc.) can be substantially more beneficial than, for example, monitoring a load on a wellhead. Maintaining the force on the conduit can enable the ability to counteract the force before a substantially vertical displacement of the intervention devices actually occurs, thereby lowering or eliminating completely such relative movement. Thus, maintaining the force on the conduit can provide integrity to the conduit, lower the amount of movement that an intervention device can withstand, and can increase the security of workers (e.g., who no longer have to work in an environment wherein heavy elements have relative movement amongst them and between them and the workers themselves).

In both the well intervention mode and drilling mode, the rooster box can monitor for the dynamic loads (i.e., downwards or upwards force) exerted on the conduit to ensure the dynamic loads do not exceed a threshold load (i.e., a load the conduit can withstand). The rooster box can also compensate for the weight of the injector and eliminate the effect of the relative movement between the injector and the conduit. The rooster box can move relative to the conduit in order to load and push pipes down the conduit.

In some embodiments, the MODU can have a derrick attached thereto (e.g., to one or more legs of the derrick) and within the derrick a rooster box (e.g., well intervention device, traveling block, etc.). The rooster box can be adapted to move along the one or more legs of the derrick. The rooster box can be coupled to at least a conduit (e.g., riser, drill pipe, pipeline, etc.), an injector, top-drive, etc. The rooster box can have an intervention frame having two configurations: an on-axis configuration (e.g., coiled tubing configuration) and an off-axis configuration (e.g., joint-pipe configuration, wireline configuration, slickline configuration, etc.). For example, in the on-axis configuration (e.g., coiled tubing configuration) the injector can be on-axis with the conduit. In the off-axis configuration (e.g., joint-pipe configuration, wireline configuration, slickline configuration), the injector can be moved off-axis in relation to the conduit. The rooster box (i.e., the intervention fame) can be configured to change from an on-axis configuration (e.g., coiled tubing configuration) to an off-axis configuration (e.g., joint-pipe drilling configuration, wireline configuration, slickline configuration, etc.).

In some embodiments, the rooster box can include one or more working platforms. The working platform can be in a fixed position with respect to, at least, the conduit, a blowout preventer (BOP), and/or the injector (i.e., enabling easy access the injector, the conduit, the BOP and other additional components with no relative movement between workers and the components). The one or more working platforms can provide workers with a stable platform for maintenance or supervision purposes.

In some embodiments, a skid can be coupled to an intervention frame and the injector. The skid can be configured to move the injector within the structure of the rooster box (i.e., when disengaged from the conduit). The skid can be substantially perpendicular to the conduit and can enable the injector to move off-axis in relation to the conduit. Movement of the injector off-axis can enable access to the conduit by workers and/or can enable switching the intervention frame to a different configuration (e.g., from coiled tubing to joint-pipe/wireline or vice-versa).

In some embodiments, when the intervention frame is configured in an off-axis configuration (e.g., joint-pipe configuration or wireline configuration) the rooster box can be configured for movement along the derrick. The movement of the rooster box along the derrick can be used for, first, loading the pipes to the top-drive and, subsequently, exerting a downward force to push the pipes downwards. The rooster box can also be used to prevent the load that the top-drive (and the rooster box itself) exerts on the conduit from exceeding a predetermined threshold load. In a wireline configuration, measuring equipment can be lowered from the one or more working platforms on the rooster box into the well in order to transmit electrical signals of well measurements to the surface (e.g., measurements for use in well intervention, reservoir evaluation, and pipe recovery).

One of the advantages of the present disclosure is the lack of individual heave intervention frames for each of the rooster boxes given that such heave intervention frames are normally expensive and/or rented for operations. The presence of the heave intervention frames can make it unlikely to combine different kinds of drilling tools given that, if, for example, the injector is disposed on top of the derrick by means of a coiled tubing lifting frame (CTLF) there is not enough space for a top-drive and the corresponding actuators along with the pipes required to perform joint-pipe drilling. Furthermore, a CTLF would not be an adequate solution for heave intervention in joint-pipe drilling. Moreover, CLTF are known for being unable to pass below a derrick (i.e., because of their large size) and can pose problems during operations (i.e., safety of the workers given the movement of the surfaces in offshore environments).

Disclosed are systems and methods of well intervention in a mobile offshore drilling unit. The mobile offshore drilling unit can include a derrick fixedly attached to a vessel. The mobile offshore drilling unit can also include a rooster box including an intervention frame configured to move the rooster box along the height of the derrick. The mobile offshore drilling unit can also include an injector configured to attach to the intervention frame, wherein the injector is configured to be releasably coupled to a conduit. The injector can be configured to be positioned on-axis with the conduit in a first configuration and off-axis with the conduit in a second configuration.

In some embodiments, the mobile offshore drilling unit can include a skid coupled to the intervention frame and slidingly coupled to the rooster box, wherein the skid is configured to enable the transfer the injector to the first configuration and to the second configuration. In at least one embodiment, the first configuration can be a coiled tubing mode. In at least one embodiment the second configuration can be a wireline mode. In other embodiments, the second configuration can be a joint-pipe mode.

In some embodiments, the mobile offshore drilling unit can include a top-drive located within the rooster box, the top-drive can be configured to operating in the second configuration by positioning a pipe-handler in contact with pipes fed to the top-drive by a tubular feeding machine.

In at least one embodiment, the rooster box can be configured to maintain an upright tension on the conduit. In other embodiments, the rooster box can be configured to monitor a compressive force on the conduit.

In some embodiment, the mobile offshore drilling unit can include the intervention frame being slidingly attached to one or more legs of the derrick. In some embodiments, the intervention frame can include one or more sensors configured to monitor forces exerted on the conduit. In some embodiments, the one or more sensors are load cells.

In some embodiments, the mobile offshore drilling unit can include the intervention frame having one or more actuators configured to move the rooster box along the height of the derrick for maintaining a force exerted on the conduit within a predefined range. In at least one embodiment, the actuator can be a hydraulic ram. In some embodiments, in response to detecting a loss of force on the conduit the actuators are configured to move the rooster box to maintain tension on the conduit. In other embodiments, in response to detecting an increase of force exerted on the conduit the actuators are configured to move the rooster box to maintain the force on the conduit within the threshold.

In some embodiments, the mobile offshore drilling unit can include a first working platform. In at least one embodiment, the first working platform can be configured to store the injector in an off-axis configuration. In some embodiments, the mobile offshore drilling unit can include a second working platform. In at least one embodiment, second working platform can be configured to enable access to a top-drive. In at least one embodiment, the second working platform can be configured to enable access the conduit for wireline operations.

BRIEF DESCRIPTION OF THE DRAWINGS

To complement the description being made and in order to aid towards a better understanding of the characteristics of the disclosure, in accordance with a preferred example of practical embodiment thereof, a set of drawings is attached as an integral part of said description wherein, with illustrative and non-limiting character, the following has been represented.

DETAILED DESCRIPTION

Figure 1:
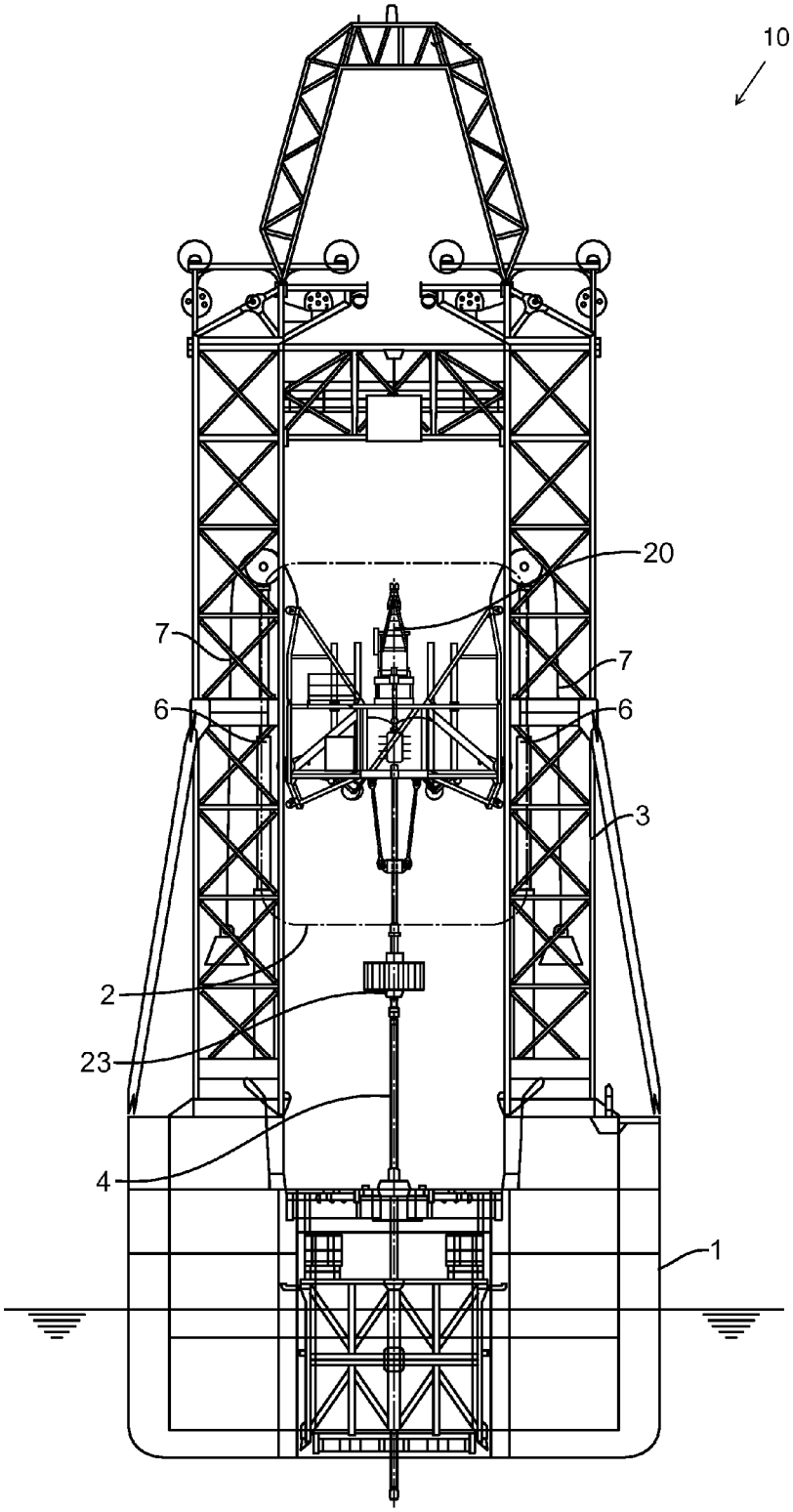
FIG. 1 illustrates a cross-section view through the moonpool of a vessel according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 illustrates an example embodiment of a mobile offshore drilling unit (MODU) 10. The MODU 10 can include at least a derrick 3, a rooster box 2, injector 20, and a conduit 4 in fluidic communication with a wellhead (not shown). The derrick 3 can be fixedly coupled to a vessel 1 (i.e., working as a supporting structure). The derrick 3 can be located over a wellhead (not shown) located on the seabed (not shown). The rooster box 2 can have relative movement with respect to the vessel 1. In at least one embodiment, the rooster box 2 can be coupled to the conduit 4 (e.g., a pipeline, a drill pipe, a riser, etc.) and configured to keep a constant relative force (e.g., an upward tension) on the conduit 4. The constant relative force can compensate for the movement of the vessel (e.g., heaves, etc.). The conduit 4 can include several instruments coupled therewith, for example blowout preventers (BOP) 24, surface trees 23, and/or other optional intermediate elements (e.g., tension relief mechanisms to avoid transferring the drill pipe tension to the wellhead).

In some embodiments, the rooster box 2 can be configured to move at least, in a linear manner along a height of the derrick 3 and perpendicular to the vessel 1 (e.g., vertically). The rooster box 2 can also monitor the force exerted by coiled tubing to the conduit to ensure the force does not exceed a predetermined threshold force (e.g., a downward force caused by the pushing of the coiled tubing).

In some embodiments, rooster box 2 can include one or more actuators 6 (e.g., a hydraulic ram at a leg of the derrick 3). The actuators 6 can be coupled to the rooster box 2 by cables 7. The actuators 6 can be configured to move the rooster box 2 vertically along the legs of derrick 3. In other embodiments, the actuators can be tuned to achieve longer action by a sheaving system.

Figure 2:
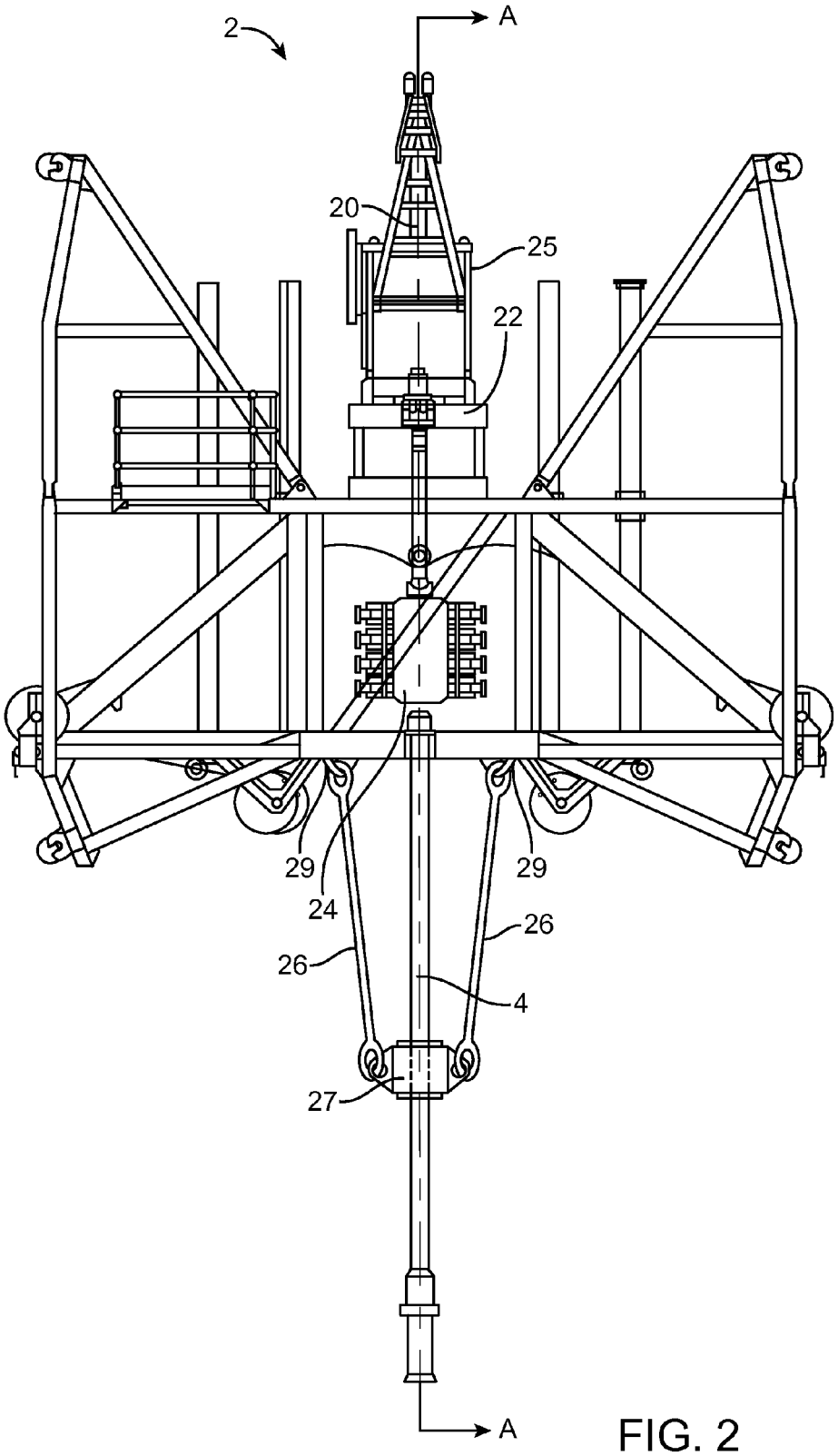
FIG. 2 illustrates a detailed view of an example embodiment of the rooster box of FIG. 1.

FIG. 2 illustrates a detailed view of rooster box 2 of FIG. 1. The rooster box 2 can include an intervention frame 25 enable to horizontally displace injector 20. The injector 20 can be coupled to the intervention frame 25 (e.g., for support and movement). The coupling between the intervention frame 25 and the injector 20 can be made through screws, rivets, or any other suitable joining portions. The injector 20 can be releasably coupled to the conduit 4 to perform coiled tubing and joint-pipe/wireline operations. When the MODU 10 is operating in a coiled tubing configuration, the injector 20 can be moved from an off-axis configuration (i.e., with respect to the conduit 4) to an on-axis configuration (i.e., with respect to the conduit 4) and the injector 20 can be coupled to the conduit 4. When MODU 10 is operating in a joint-pipe or wireline configuration, the injector 20 can be moved from an on-axis configuration (i.e., with respect to the conduit 4) to an off-axis configuration (i.e., with respect to the conduit 4) and the injector 20 can be decoupled from the conduit 4.

Figure 4:
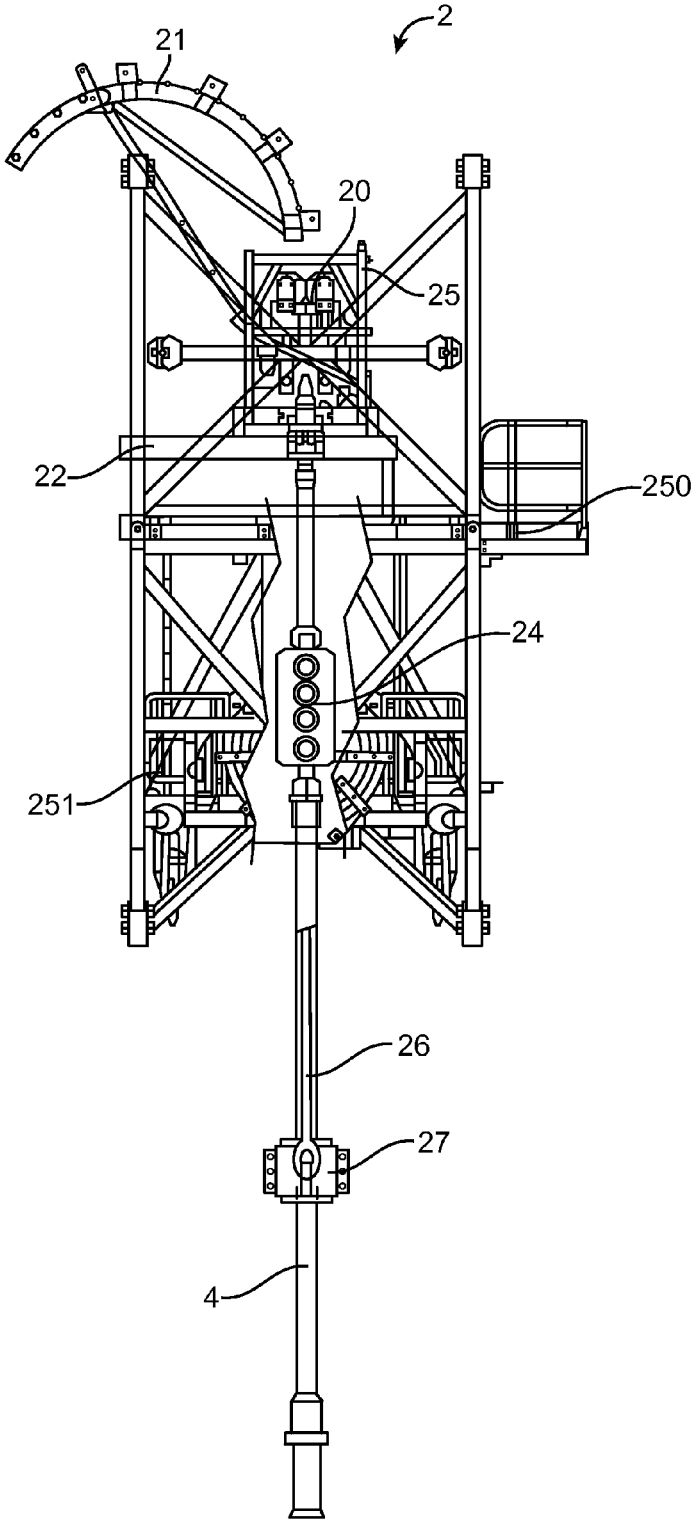
FIG. 4 illustrates a cross-section A of FIG. 2 with the intervention frame in an on-axis configuration with respect to the conduit.
Figure 5:
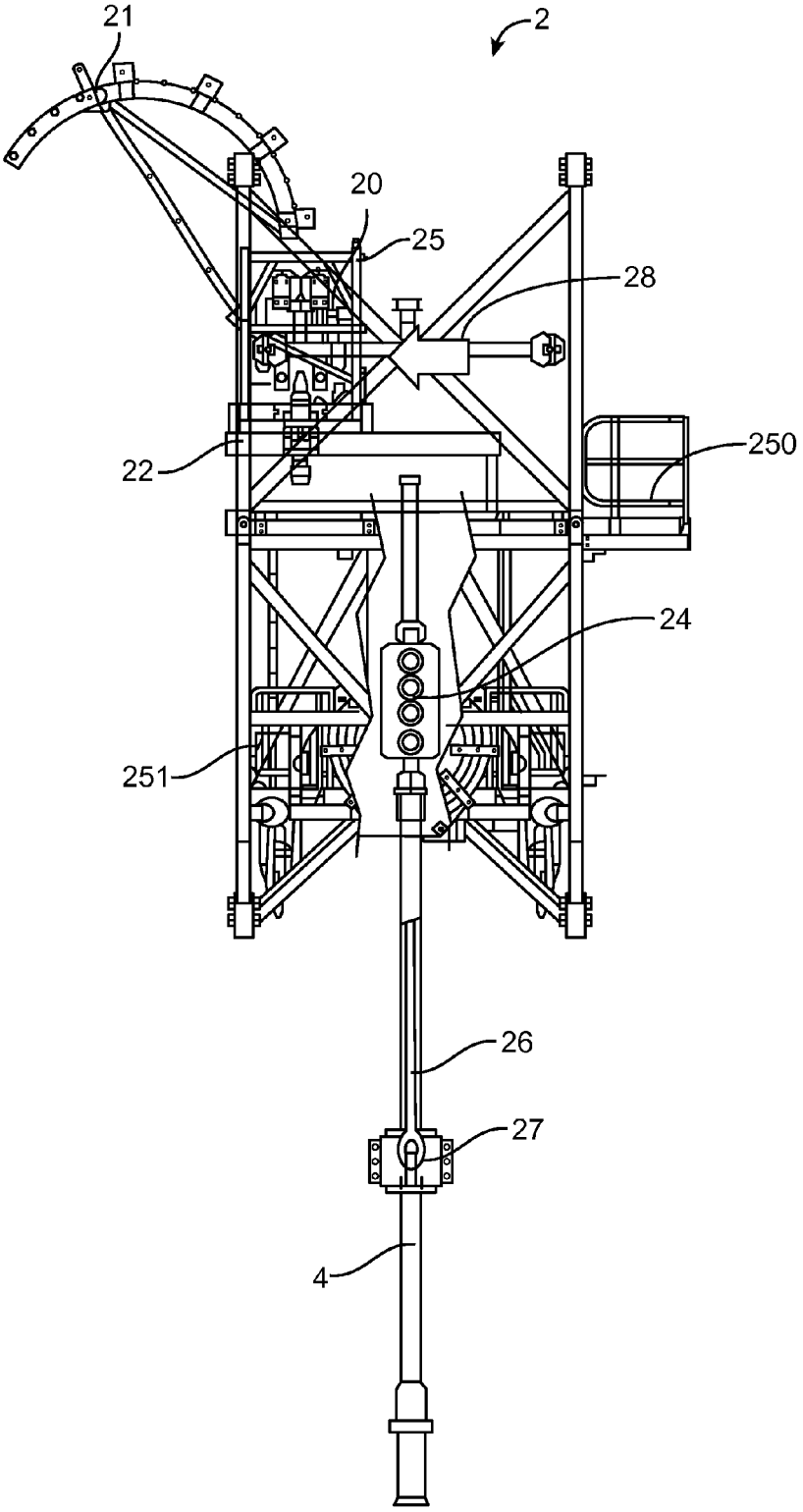
FIG. 5 illustrates a cross-section A of FIG. 2 with the intervention frame in an off-axis configuration with respect to the conduit.

In some embodiments, the intervention frame 25 can be coupled to a skid 22 (i.e., to which the injector 20 is to be attached). The coupling between the skid 22 and the intervention frame 25 can be made through screws, rivets, or any other suitable joining portions. Additionally, the skid 22 can enable movement of the injector 20 while maintaining the coupling to the intervention frame 25. The skid 22 can project perpendicularly with respect to the vertical axis of the conduit 4. The attachment of the intervention frame 25 and the skid 22 enables the injector 20 to slide along the skid 22 to change from an on-axis configuration to an off-axis configuration (as shown in FIGS. 4 and 5).

In other embodiments, the rooster box 2 can also include one or more sensors 29 (e.g., one or more load cells). The one or more sensors can be configured to monitor the forces exerted on the conduit 4. In some embodiments, the sensors 29 can be located at the top of links 26 and configured to read the force exerted on load structure 27. In some embodiments, the sensors 29 can continually monitor the forces exerted on the conduit 4 (i.e., at load structure 27). In response to the sensors 29 detecting a predetermined threshold force, the rooster box 2 can be adjusted (i.e., vertically) by the actuators 6. In other embodiments, a first sensor can be configured to measure upward tension (i.e., to be maintained during coiled tubing drilling) and a second can be configured to determine the force applied by the top drive 5 (i.e., during joint-pipe drilling). The sensors 29 can be load cells, tension sensors, and/or pressure sensor, or any other sensor known in the field.

Figure 3:
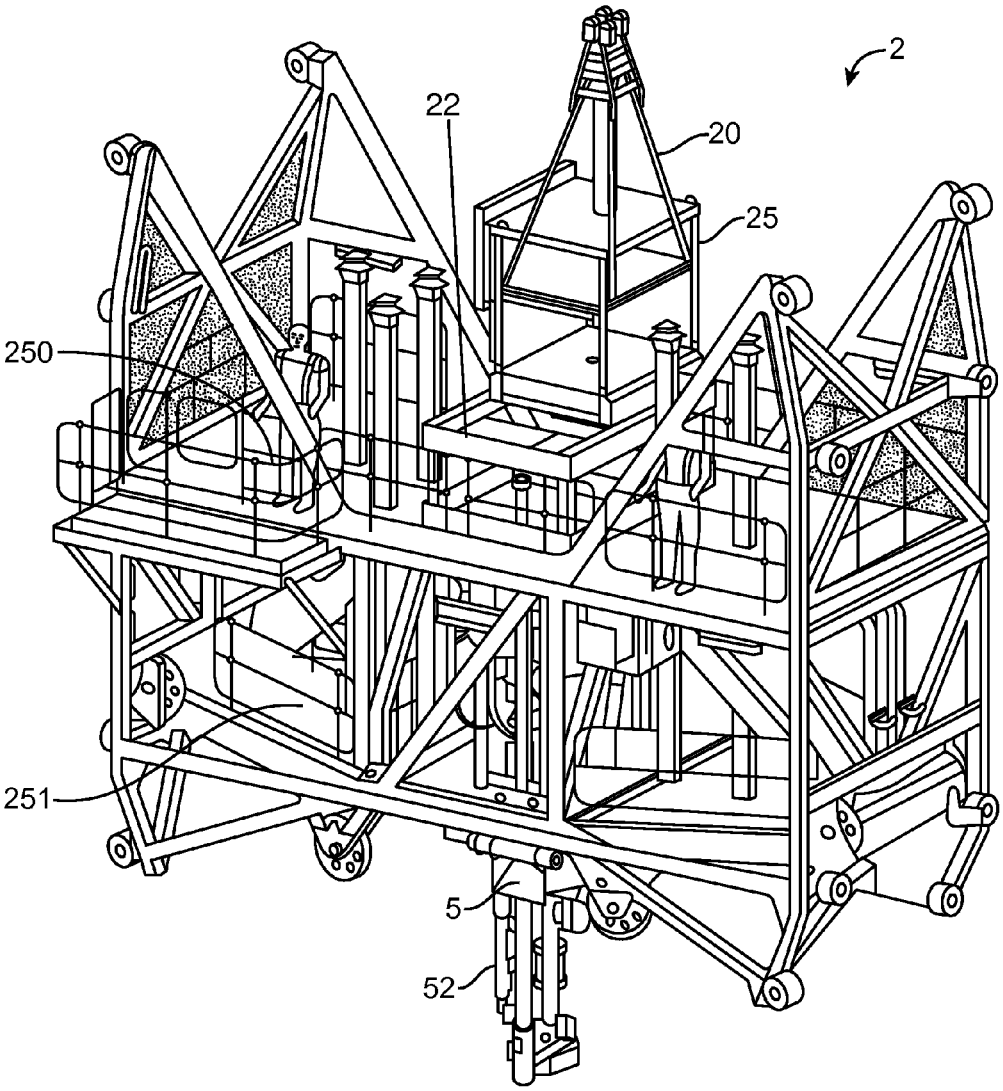
FIG. 3 illustrates a detailed view of an example embodiment of the rooster box in an off-axis configuration.

FIG. 3 illustrates the rooster box 2 configured in an off-axis configuration with an upper working platform 250 and lower working platform 251. The top-drive 5 can be located within the rooster box 2 and can be moved to an operating position, whereas the injector 20 can be moved to an off-axis configuration position (i.e., inactive position) by intervention frame 25. On its operating position, the top-drive 5 can be configured to position the pipe-handler 52 to be in contact with pipes that are fed to the top-drive 5 by a tubular feeding machine (not shown). In other embodiments, when injector 20 is configured in the off-axis configuration, MODU 10 can be configured for use in a wireline mode (i.e., lower measurement devices into the well for transmitting electrical measurements from the well).

The intervention frame 25 can be configured to work in different configurations (i.e., on-axis configuration and off-axis configuration). In some embodiments, where there is no longer a need to maintain a top-tension on a conduit 4 (i.e., during joint-pipe drilling operations) the intervention frame 25 can move (i.e., off-axis) to enable pipes to be fed by the top-drive 5 (i.e., joint-pipe operations). The top drive 5 can connect the pipes and, by the actuators 6 on the intervention frame 25 push the pipes through the wellhead using the movement mechanism of the rooster box 2 along the derrick 3 while measuring and ensuring the tension on the conduit is within an threshold range (i.e., to enable safe operations). Regardless of the differences of the configurations, the elements within the intervention frame 25 are substantially equivalent because, a force can be to be applied to pipes and this force can be monitored (i.e., by sensors 29) to ensure the force does not exceed a threshold force (e.g., a maximum operating force) on pipes (i.e., to avoid damage). The monitoring can be performed by sensors 29 configured to monitor the tension on the conduit 4 (e.g., during coiled tubing drilling an upward tension and a downward force during a joint-pipe drilling).

In some embodiments, the intervention frame 25 can include a working platform 250 to enable performance of operations and maintenance on the conduit 4, injector 20, the BOP, coil tubing tools, coiled tubing components, controlling well access, down hole tools, etc. The removal of relative movement between intervention frame 25 and working platform 250 enables better working conditions and improves the ergonomics and safety of workers. Working platform 250 can also be configured to store the injector 20 when in off-axis configuration. In some embodiments, a lower working platform 251 can be used for accessing the top-drive 5, conduit 4 (e.g., during joint-pipe operations or wireline operations). Workers can also use working platform 250 and lower working platform 251 to operate MODU 10 in a wireline configuration.

In some embodiments, while operating in wireline mode workers can utilize platforms 250 and 251 for measuring and inspecting the components of well intervention device 10 (e.g., injector, drill pipe, etc.). With the use of platforms 250 and 251, the measuring and inspecting operations can be performed expeditiously (i.e., there can be multiple workers on the platforms and the workers will no longer need to be harnessed to a crane or have to climb up the derrick to perform the operations).

FIG. 4 illustrates rooster box 2 where the injector 20 is in an on-axis configuration (i.e., with respect to the conduit 4). In the on-axis configuration, the injector 20 can pull pipe from a coil (not shown) through the gooseneck 21 and push the pipe through the conduit 4. The piping being pushing through the conduit 4 can exert a downward force on the conduit 4 that can diminish the tension on the conduit 4. In some embodiments, the intervention frame 25 can move upwards to maintain the tension on the conduit 4. In some embodiments the intervention frame 25 can detect a loss of tension on the conduit 4. After the detection of the loss of tension on the conduit 4, a vertical displacement of the rooster box 2 can occur to maintain tension within a predetermined threshold. In some embodiments, tension variations can occur as a result of meteorological conditions modifying the position of a vessel with respect to a conduit 4. In response to the tension variations, the rooster box 2 can move vertically to compensate for the tension variations caused by the meteorological conditions.

FIG. 5 illustrates rooster box 2 where the injector 20 in an off-axis configuration (i.e., with respect to the axis of the conduit 4). The intervention frame 25 and/or the injector 20 can be disengaged and displaced as shown by arrow 28 (e.g., either manually, automatically or semi-automatically). For example, an automatic approach can include an electrical motor to move the injector from an on-axis configuration to an off-axis configuration upon receipt of a control signal.

In some embodiments, while the injector 20 is at an off-axis configuration (i.e., with respect to the axis of conduit 4), the top of the conduit 4 is available for inspection (e.g., manual operations by workers supported by working platforms 250 and 251, while the injector and/or the conduits top portion 20 remains in a substantially compensated environment—attached to the intervention frame 25). The inspection can be performed in a heave compensated environment (i.e., with no relative movement amongst the devices and the operators, which enables safer working conditions).

The vessel 1 can modify the working operation from a coiled tubing configuration to joint-pipe configuration by changing the configuration of the top-drive 5 from an off-axis configuration to an on-axis configuration. In another embodiment, vessel 1 can operate in a wireline mode (e.g., lower measuring devices into the well for well intervention). In some embodiments, vessel 1 can switch operations between a coiled tubing configuration and a wireline configuration approximately 40-60 times per project. Skid 22 can enable quick movement of the injection 20 (by intervention frame 25) from an on-axis position to an off-axis position (and vice versa). Switching the injection 20 quickly between on-axis and off-axis enables the ability to cost effectively drill evaluation wells.

Although the present invention has been disclosed in reference to a passive heave compensation system, it should be understood that an ordinary person skilled in the art would be able to modify the system to work in an active compensation system (e.g., to be able to perform coil tubing drilling operations).

Although a variety of examples and other information was used above to explain aspects within the scope of the appended claims, no limitation of the claims should be implied based on particular features or arrangements in such examples, as one of ordinary skill would be able to use these examples to derive a wide variety of embodiments. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

The invention claimed is:

1. A mobile offshore drilling unit comprising:

a derrick fixedly attached to a vessel;

a rooster box configured to move along a height of the derrick including frame and a skid, the frame configured to move along the skid horizontal to the height of the derrick between an on-axis configuration and an off-axis configuration;

an injector configured to attach to the frame, wherein the injector is configured to be releasably coupled to a conduit in the on-axis configuration and decoupled from the conduit in the off-axis configuration; and the rooster box including one or more sensors for ensuring dynamic loads exerted on the conduit do not exceed a threshold load and in response to the threshold load being exceeded vertically moving the rooster box.

2. The mobile offshore drilling unit of claim 1, wherein the on-axis configuration is a coiled tubing mode.

3. The mobile offshore drilling unit of claim 1, wherein the off-axis configuration is a wireline mode.

4. The mobile offshore drilling unit of claim 1, wherein the on-axis or off-axis configuration is a joint-pipe mode.

5. The mobile offshore drilling unit of claim 4, further comprising a top-drive located within the rooster box, the top-drive being configured to operate in the off-axis configuration by positioning a pipe-handler in contact with pipes fed to the top-drive by a tubular feeding machine.

6. The mobile offshore drilling unit of claim 1, wherein the rooster box is configured to maintain an upright tension on the conduit.

7. The mobile offshore drilling unit of claim 1, wherein the rooster box is configured to monitor a compressive force on the conduit.

8. The mobile offshore drilling unit of claim 1, wherein the rooster box is slidingly attached to one or more legs of the derrick.

9. The mobile offshore drilling unit of claim 1, wherein the one or more sensors are load cells.

10. The mobile offshore drilling unit of claim 1, wherein the rooster box includes one or more actuators configured to move the rooster box vertically along the height of the derrick for maintaining a force exerted on the conduit within a predefined range.

11. The mobile offshore drilling unit of claim 10, wherein the one or more actuators are hydraulic rams.

12. The mobile offshore drilling unit of claim 10, wherein in response to detecting a loss of force on the conduit the one or more actuators are configured to move the rooster box to maintain tension on the conduit.

13. The mobile offshore drilling unit of claim 12, wherein, in response to detecting an increase of force exerted on the conduit the one or more actuators are configured to move the rooster box to maintain the force on the conduit within the threshold.

14. The mobile offshore drilling unit of claim 1, further comprising a first working platform.

15. The mobile offshore drilling unit of claim 14, wherein the first working platform is configured to enable access to, at least the injector and its surrounding area.

16. The mobile offshore drilling unit of claim 14, wherein the first working platform is configured to store the injector in the off-axis configuration.

17. The mobile offshore drilling unit of claim 14, further comprising a second working platform.

18. The mobile offshore drilling unit of claim 17, wherein the second working platform is configured to enable access to a top-drive and an area surrounding the top-drive.

19. The mobile offshore drilling unit of claim 17, wherein the first or second working platform is configured enable access to the conduit for wireline operations.

* * * * *